United States Patent [19]

Akihama et al.

[11] Patent Number: 5,010,705

[45] Date of Patent: Apr. 30, 1991

[54] CURTAIN WALL

[75] Inventors: Shigeyuki Akihama, Kanagawa; Mikio Kobayashi, Tokyo; Tatsuo Suenaga, Tokyo; Toshiyuki Fukumoto, Tokyo; Yoshikazu Taniguchi, Tokyo; Hiroaki Nakagawa, Tokyo, all of Japan

[73] Assignee: Kajima Corporation, Tokyo, Japan

[21] Appl. No.: 517,224

[22] Filed: May 1, 1990

Related U.S. Application Data

[62] Division of Ser. No. 339,788, Jan. 4, 1989.

[51] Int. Cl.[5] ..... E04C 2/26; E04C 2/46; E04B 2/88

[52] U.S. Cl. ..... 52/477; 52/235; 52/677; 52/648; 52/484; 52/601

[58] Field of Search ..... 52/477, 484, 235, 648, 52/677, 601, 600, 315

[56] References Cited

U.S. PATENT DOCUMENTS

| | | | |
|---|---|---|---|
| 1,579,015 | 3/1926 | Marks | 52/484 |
| 1,891,512 | 12/1932 | Venzie | 52/484 |
| 1,896,290 | 2/1933 | Davis | 52/484 |
| 2,704,935 | 3/1955 | Uddenborg | 52/677 |
| 2,825,221 | 3/1958 | Brouk | 264/261 |
| 3,245,185 | 4/1966 | Rowe | 52/315 |
| 3,381,066 | 4/1968 | Lowe | 264/256 |
| 3,852,930 | 12/1974 | Maaman | 52/600 |
| 4,743,414 | 5/1988 | Sudrabin | 52/309.17 |

*Primary Examiner*—John E. Murtagh
*Attorney, Agent, or Firm*—Wenderoth, Lind & Ponack

[57] ABSTRACT

A curtain wall building panel having a metal frame secured to the reverse side of a concrete panel with flexible anchors. A 3-D braid is formed in such a manner that non-metallic fibers are braided in the three directions at a pitch of 5 mm or more and have a self-supporting characteristic. The braid is embedded in the concrete panel and the front ends of the flexible anchors are secured to cell spaces in the 3-D braid. The curtain wall exhibits excellent bending strength, can be easily manufactured and can be used for exterior finish of multistory buildings. A method of making the building panel is also disclosed.

10 Claims, 7 Drawing Sheets

CURTAIN WALL

This application is a Rule 1.60 divisional application of Ser. No. 07/339,788, filed Jan. 4, 1989.

TECHNICAL FIELD

This invention relates to a metal stud frame type curtain wall or building panel in which a metal frame is secured to the rear face of a thin concrete panel with flexible anchors, and to a method for manufacturing the same.

BACKGROUND OF THE ART

Steel stud frame type curtain walls have been conventionally known to comprise a thin, large exterior curtain wall, this type of curtain wall being constituted in such a manner that a steel frame is secured to the rear face of a GRC (Glass-Fiber Reinforce Concrete) panel with flexible anchors. The type of curtain wall has been widely used, particularly in the U.S.A., and has achieved much success.

FIG. 1 shows a perspective view of the overall shape of the same. In FIG. 1, reference numeral 1 represents a GRC panel, reference numeral 2 represents a steel stud frame, and reference numeral 3 represents flexible anchors. The characteristics of a steel stud frame type curtain wall lies in its structure so constituted that the rear face on the GRC panel 1 with a thickness of the order of 12 mm is reinforced by the steel stud frame 2, the GRC panel 1 being assumed to be similar to the surface plate of a metal curtain wall. The GRC panel 1 having a standard size surface area of 2230×5200 mm and the steel stud frame 2 are connected by the flexible anchors 3 which are disposed at intervals of 50 to 60 cm (FIG. 1 is used to illustrate the overall structure; therefore, the dimensions, shapes and details shown in the figure are different from those of a standard size GRC panel). The design concept of the flexible anchors 3 lies in the fact that any changes in the dimensions of the GRC panel 1 should not be restricted by the steel stud frame 2. If the GRC panel 1 is distorted by wind pressure or is thermally deformed, the flexible anchors 3 serve to absorb these changes. Therefore, it is important for the overall structure that the proof stress and reliability of the flexible anchors 3 are guaranteed.

OBJECT OF THE INVENTION

The steel stud frame type curtain walls of the type described above involve the following disadvantages:

(1) As is well known, GRC suffers from a problem of deterioration in strength.

(2) Since GRC panels contract greatly when they dry out, tile finish is impratical. That is because the curtain walls may warp or undergo deflections due to the difference in dry shrinkage between the rear face of tiles and the surface of a GRC panel, which leads to generation of cracks and separation of the tiles. As a result, painting is substantially the only finish of the surface available, considerably reducing the estimation of the material for use in exterior finish.

(3) Since GRC cannot be kneaded nor mixed when GRC panels are manufactured, it is necessary for the same to be formed in a mold to a predetermined thickness by alternately spraying glass fibers and concrete-mix. However, this processing (direct spraying method of four to five layers) described above inevitably suffers from reduced productivity, and a poor working environment. Furthermore, since this work is hand work, it requires skilled labor and poses a problem of maintaining precision.

(4) When the flexible anchors and the GRC panel are connected, as shown in FIG. 2, an end portion 4 of each flexible anchor 3 which has been preformed in L-shape usually from a steel bar, is disposed along the reverse face of the GRC panel and then a padding portion 5 (bonding pad) of GRC is formed so as to cover the end portion 4. This jointing operation is conducted in such a state that the steel stud frame 2 and the flexible anchor 3 have been previously welded (reference numeral 6 represents the welded portion). Therefore the efficiency of forming of the bonding pad 5 is very poor and it must be conducted manually. With this it is very difficult to obtain sufficient reliability in the strength of the joint.

(5) When this type of curtain wall is used in exterior finish of multistory buildings, it will necessarily be subjected to very strong wind pressures. In order to ensure strength which withstands such wind pressures and to absorb potential changes in dimension due to deflection, the flexible anchors perform a very important role. However, it is very difficult to obtain the necessary reliability with the fonding pad 5 described in (4). Although a method which can absorb the changes in dimension of the GRC panel has been disclosed, in which the front end portion 4 of the flexible anchor 3 is, as shown in FIG. 3, slidably inserted into a pipe 7 which is joined to the reverse face of the GRC panel 1 with the assistance of the fonding pad 5, the same disadvantages are experienced with respect to the jointing process and the reliability in strength of the joint of the bonding pad 5 as with the method described above.

An object of the present invention is to overcome the above-described disadvantages associated with the conventional curtain walls of steel stud frame type.

SUMMARY OF THE INVENTION

The invention provides a curtain wall of metal stud frame type in which a metal frame is secured to the reverse side of a concrete panel with flexible anchors, characterized in that a 3-D braid formed in such a manner that fibers are braided in the three directions at a pitch of 5 mm or more and having a self-supporting characteristic is embedded in a skin of the concrete panel and the front ends of the flexible anchors are secured to cell spaces in the 3-D braid. The curtain wall utilizing the 3-D braid according to the present invention can substantially overcome all of the above-described disadvantages associated with the GRC panels, and a novel exterior curtain wall is thereby provided. In the present invention, tile finish can be freely conducted to finish the surface of the curtain wall. As a result of this, the invention provides a metal stud frame type curtain wall finished with tiles.

Further, the present invention provides a method for manufacturing the above-described metal stud frame type curtain wall which comprises, connecting a 3-D braid to a metal frame with flexible anchors, the 3-D braid being formed in such a manner that fibers are braided in three directions at a pitch of 5 mm or more and having a self-supporting characteristic; setting the braided portion of the assembly so constructed in a mold; and placing a concrete mix into the mold. Furthermore, the invention provides a method for manufacturing a metal stud frame type curtain wall comprising, connecting a 3-D braid to a metal frame with flexible anchors, the 3-D braid being formed in such a manner that fibers are braided in three directions at a pitch of 5 mm or more and having a self-supporting characteristic; setting the braided portion of the assembly so constructed in a mold in which tiles or stone materials are laid; and placing a concrete mix into the mold.

DETAILED DESCRIPTION OF THE INVENTION

Figure 1:
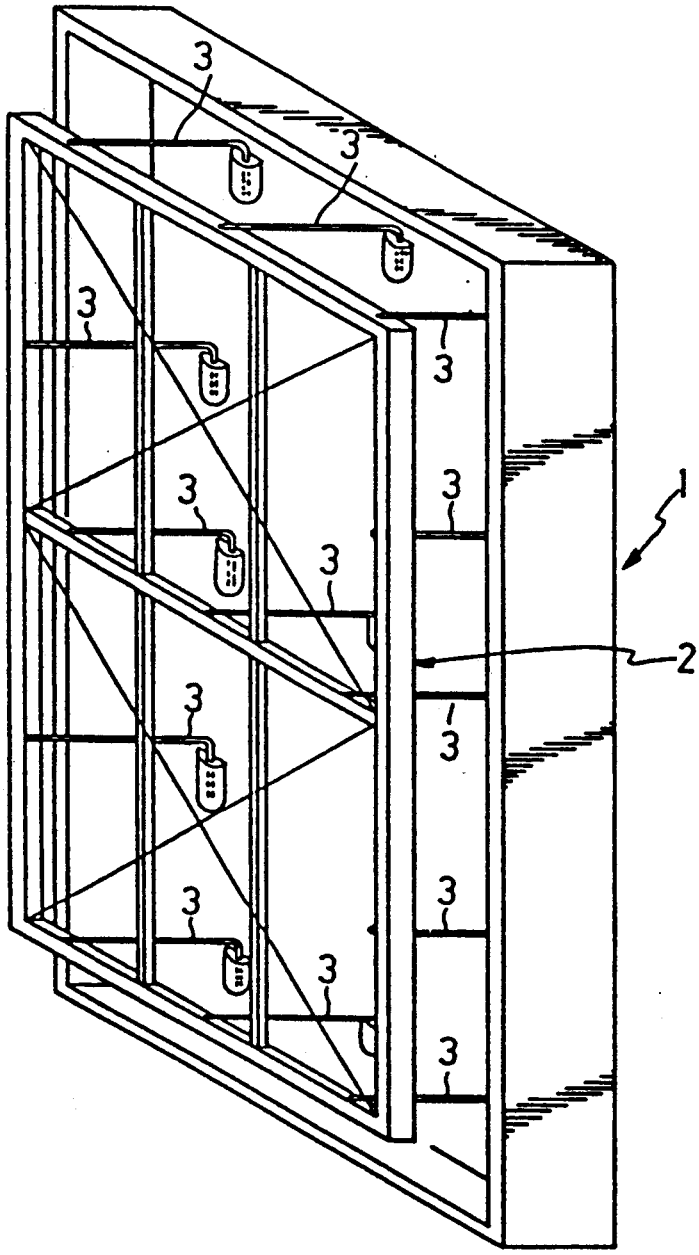
FIG. 1 (PRIOR ART)
FIG. 1 is a perspective view of a conventional steel stud frame type curtain wall.
Figure 2:
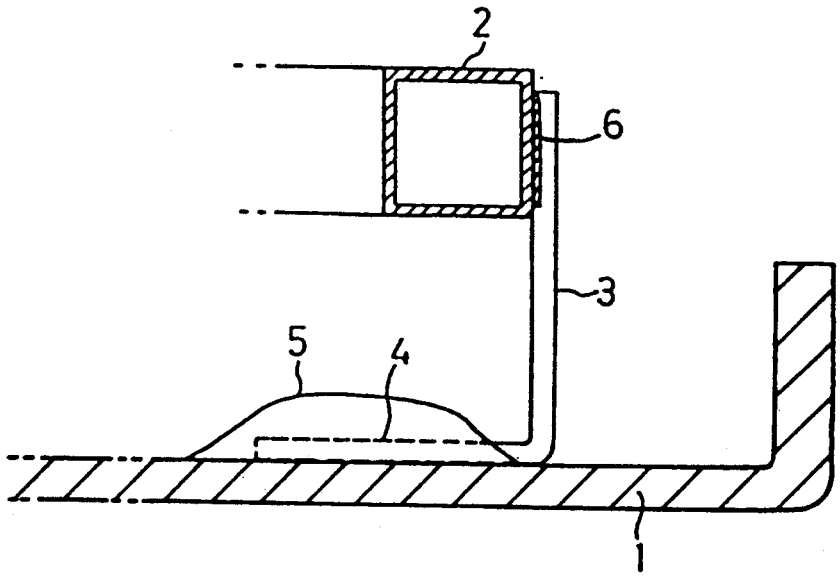
FIG. 2 (PRIOR ART)
FIG. 2 is a schematic cross-sectional view illustrating a state wherein a flexible anchor of the conventional steel stud frame and a panel of the same are joined.
Figure 3:
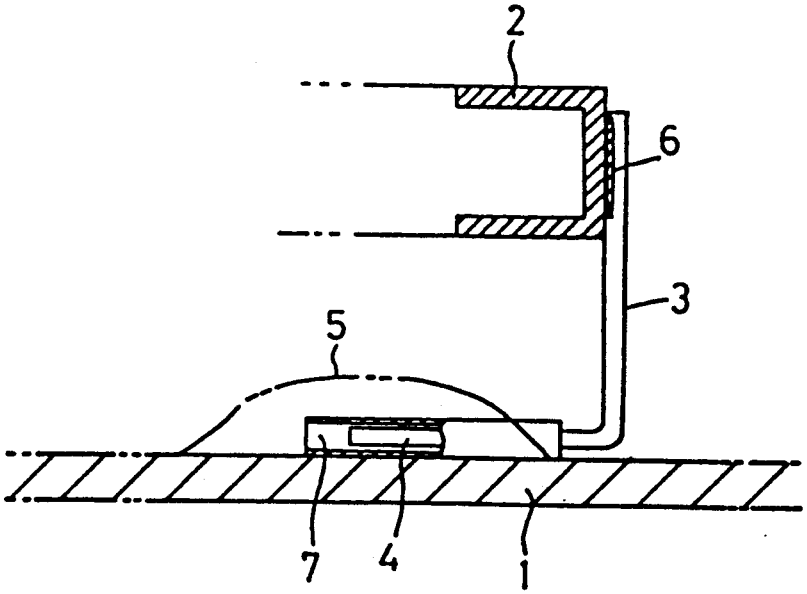
FIG. 3 (PRIOR ART)
FIG. 3 is a schematic cross-sectional view illustrating another state wherein a flexible anchor of the conventional steel stud frame and a panel of the same are joined.

A 3-D braid embeded in a skin of a concrete panel of a metal stud frame type curtain wall or building panel according to the present invention is constituted in such a manner that 3-D lattices thereof are continuously formed in the longitudinal, lateral and vertical directions similar to a junglegym in a playing field by stereoscopically braiding fibers at a predetermined pitch, and the stereoscopic form of the 3-D braid can be self-supporting. The fibers forming such a 3-D braid are exemplified by a carbon fiber, aramid fiber, glass fiber, Vinylon (Reg. JM) type fiber, formalized polyvinylalcohol polyethylene type fiber, metal fiber such as a stainless fiber or amorphous fiber. It is necessary that each cell (unit lattice) of the 3-D braid is sufficiently filled with concrete. Therefore, according to the present invention, a 3-D braid having each unit cell with a length of 5 mm or more in the longituidinal, lateral and vertical directions is used. Since the thickness of the skin of the panel can be reduced sufficiently according to the present invention, it is advantageous to use a plate-like 3-D braid. In a case where such plate-like 3-D braid is used, a single-stage type of 3-D in which only one cell is present in the direction of the thickness of the plate can be used.

Concrete panels are reinforced by embedding a 3-D braid of the type described above. The concrete mix may comprise mortar or concrete mix using usual portland cement, and fiber reinforced mortar or concrete mix may be used in which short fibers are dispersed in the mix. The short fibers to be dispersed are preferably carbon, aramid and metal fibers.

Although the metal frame may usually comprise steel frames, metals or alloys other than steel can be used.

According to the present invention, a metal stud frame type curtain wall can be easily manufactured by previously connecting the above-described 3-D braid to a metal frame with flexible anchors, setting the 3-D braid portion of the assembly so constructed in a mold, and placing a concrete mix in the mold. At this time, by placing tiles or stone materials in the mold a curtain wall in which the surface of the concrete panel thereof is finished with the tiles or stones can be obtained. As described above, according to the present invention, the problem experienced in the conventional case where spray forming is used can be overcome. Furthermore, a manufacturing step such as jointing operation by means of padding the flexible anchors becomes unnecessary and the excellent reliability in the joining strength between the flexible anchors and the concrete panel can be obtained. According to the present invention, not only can sufficient strength be secured by the 3-D braid but also any problems due to the use of glass fiber can be overcome in comparison with the GRC panel. As a result of this, surfaces thereof can be finished with tiles, and the finishing work can be easily conducted.

Referring to the drawings the present invention will now be specifically described.

Figure 4:
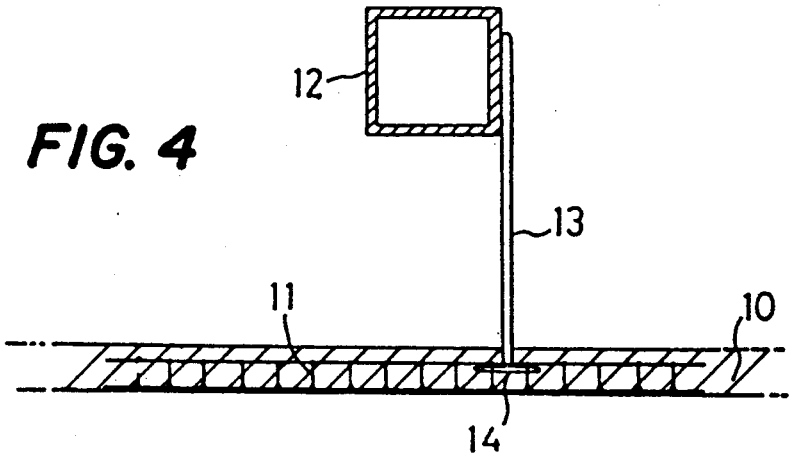
FIG. 4 is a schematic cross-sectional view illustrating a state wherein a flexible anchor of a metal stud frame type curtain wall according to the present invention and a concrete panel of the same are joined.

FIG. 4 illustrates an essential portion of a metal stud frame type curtain wall according to the invention, in which reference numeral 10 represents a skin portion of a concrete panel. Reference numerall 11 represents a 3-D braid embedded in the concrete panel, reference numeral 12 represents a metal frame, and reference numeral 13 represents a flexible anchor. The metal frame 12 corresponds to the steel frame 2 shown in the conventional example illustrated in FIG. 1, and the flexible anchor 13 also corresponds to the flexible anchor 3 shown in FIG. 1. According to the present invention, the front end portion of the flexible anchor 13 is embeded in the layer of the concrete panel 10, therefore the fonding pads need in the conventional example are not present. The front end of the flexible anchor 13 is provided with a hook portion 14 which is secured to cells of the 3-D braid 11.

Figure 5:
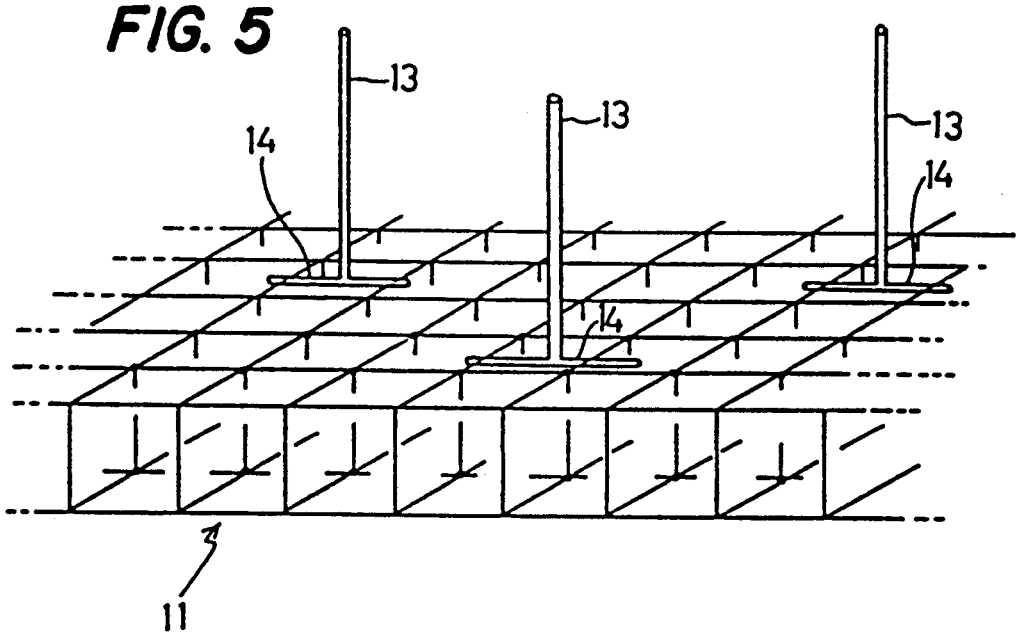
FIG. 5 is a partial perspective view illustrating a relationship between the 3-D braid and the flexible anchors which are joined together.

FIG. 5 illustrates an engaging relationship between the 3-D braid 11 and the flexible anchors 13. In this illustration, T-shaped hook portion 14 is secured to the front end portion of the flexible anchor 13 and the T-shaped hook portion 14 is inserted into cells of the 3-D braid 11 for the purpose of securing it.

Figure 6:
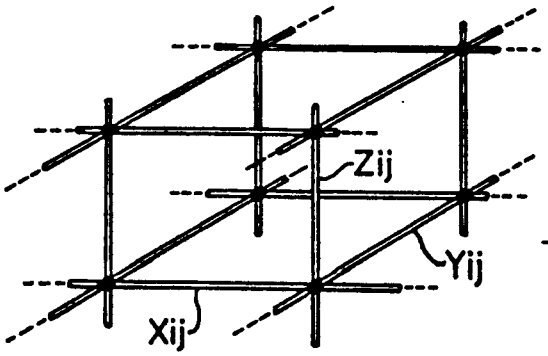
FIG. 6 is a partial perspective view illustrating a state of a unit lattice of the 3-D braid.
Figure 7:
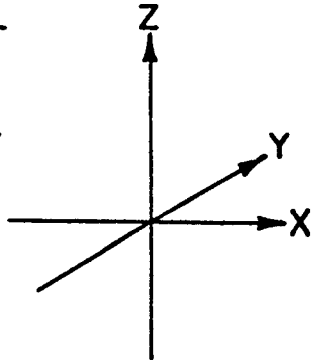
FIG. 7 is a view of three directions for illustrating directions of fibers of the 3-D braid shown in FIG. 6.

FIG. 6 illustrates a unit cell of the 3-D braid 11. It is assumed that the three directions are, as shown in FIG. 7, represented by X axis, Y axis and Z axis, the fibers in the X direction are called first abscissa fibers Xij, fibers in the Y direction are called second abscissa fibers Yij, and the fibers in the Z direction are called vertical fibers Zij. The first abscissa fibers Xij which are disposed in parallel and at a substantially similar pitch, the second abscissa fibers Yij which are disposed in parallel and at a substantially similar pitch, and the vertical fibers Zij which are disposed in parallel and at a substantially similar pitch intersect with a certain regularity. The 3-D braid can be constructed by forming meshes with the crossing points. That is, a multiplicity of the first abscissa fibers Xij are disposed in parallel at a substantially constant pitch in such a manner that they are respectively disposed perpendicular to the Y axis, and a multipliciy of the same are disposed in parallel at a substantially constant pitch in such a manner that they are respecively disposed perpendicular to the Z axis. Similarly, a multiplicity of the second abscissa fibers Yij are disposed in parallel at a substantially constant pitch in such a manner that they are respectively disposed perpendicular to the Z axis, and a multiplicity of the same are disposed in parallel at a substantially constant pitch in such a manner that they are respectively disposed perpendicular to the X axis. In a manner similar to the above, a multiplicity of the vertical fibers Zij are disposed in parallel at a substantially constant pitch is such a manner that they are respectively disposed perpendicular to the Y axis, and a multiplicity of the same are disposed in parallel at a substantially constant pitch in such a manner that they are respectively disposed perpendicular to the X axis. Furthermore, the crossing points formed by intersection of the fibers in the three directions are constituted at all of the above-described pitches, these crossing points being formed by stitches. Consequently, as illustrated in FIG. 6, a cubic or rectangular solid unit lattice (cell) having crossing points at eight corners thereof is formed by four first abscissa fibers, four second abscissa fibers and four vertical fibers. The unit lattices are distributed in three directions with certain regularities. If the rigidity of fibers is insufficient to maintain the stereoscopic shape of the 3-D braid, the fibers may be impregnated or applied with a resin for the purpose of giving them such a self-supporting characteristic.

Since the 3-D braid according to the present invention uses strong fibers such as carbon, aramid, venylon (Reg. TM) type, polyethylene type, stainless steel, amorphous fibers or the like, and such a 3-D braid is embedded in the concrete panel, sufficient tensile strength can be obtained in the three directions, and the bending strength can be significantly improved.

Since it is necessary for the 3-D braid according to the present invention that a mortar mix or a concrete mix can be sufficiently packed in each unit lattice of the 3-D braid due to its fluidity, the pitch is need to be at least 5 mm. However, if the pitch is too large, for example, it is 70 mm or more, the self-supporting characteristics are difficult to obtain. Therefore, the pitch is preferably less than 70 mm. If the pitches range between 5 to 70 mm, the pitches in the three directions need not be the same, and they may be different from each other. Furthermore, a 3-D braid 11 may be, as shown in FIG. 5, used which is formed by a single stage in the Z direction which is formed by two first abscissa fibers Xij in the X direction and two second abscissa fibers Yij in the Y direction. Furthermore, a 3-D braid formed by a multiplicity of fibers (more than two) in the Z direction may be used. The number of stages may be determined depending upon the thickness of the concrete panel 10 and the pitch of the 3-D braid. As for the inner surface direction of the concrete panel 10, the 3-D braid may be disposed so as to substantially cover the surface area of the panel. If the surface area of the panel cannot be covered by one 3-D braid, a plurality of the 3-D braids may be disposed so as to cover it. Although in FIGS. 4 and 5, the T-shaped hook portion 14 is provided at the front end portion of the flexible anchor 13, an L-shaped hook portion may be used, and any shaped hook portion may be secured to the front end portion of the flexible anchor 13 so long as the anchors can be secured to the 3-D braid 11.

Figure 8:
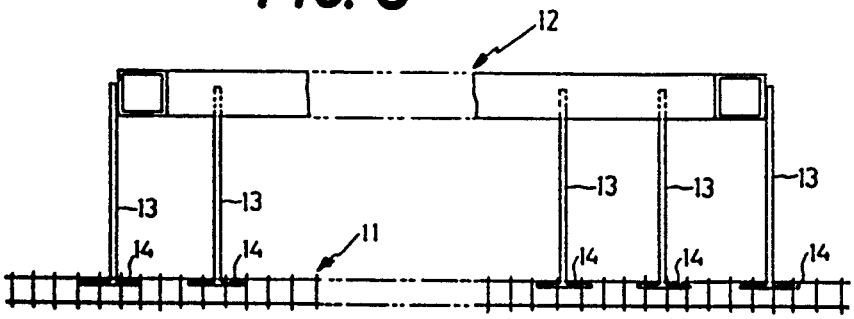
FIG. 8 is a schematic cross-sectional view illustrating a step in a method for manufacturing the steel stud frame type curtain wall according to the present invention.
Figure 9:
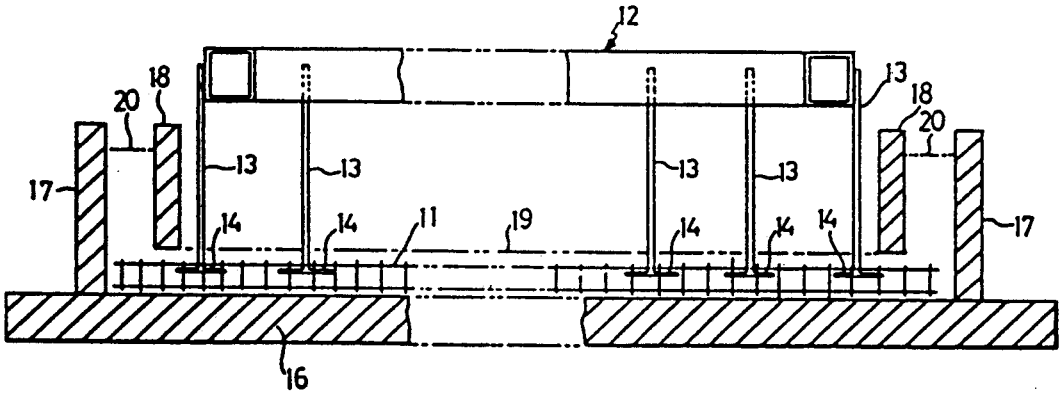
FIG. 9 is a schematic cross-sectional view illustrating a subsequent step in the method.
Figure 10:
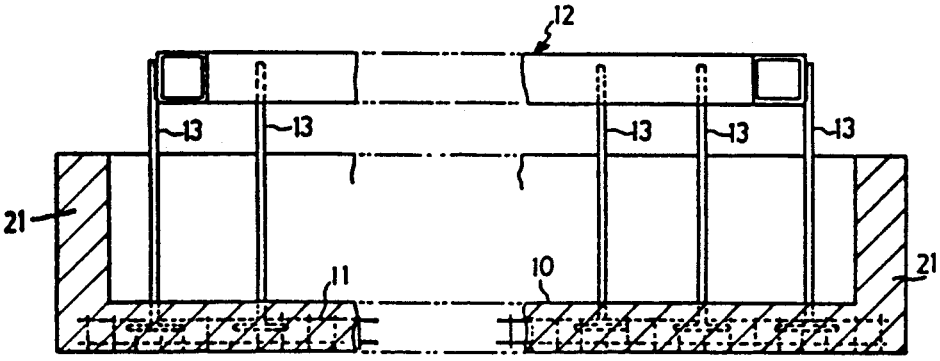
FIG. 10 is a schematic cross-sectional view illustrating an example of a shape of the curtain wall obtained by the above-described manufacturing method.

FIGS. 8 to 10 illustrate a representative method of manufacturing the curtain wall according to the present invention. The manufacturing steps will be described with reference to FIGS. 8 to 10.

First, the metal frame 12 with a predetermined shape and structure is previously manufactured by welding, for example. The frame 12 may be formed of a material selected from various materials such as a metal plate, channel, angle, pipe or bar steel having a cross sectional shape of an I, U facing sidewards, square, T, crest-like, and U facing downwards. Next, the flexible anchors 13 are welded at one end thereof to the metal frame 12 at a predetermined interval. Then the metal frame 12 is laid horizontally, and the 3-D braid 11 is hung in such a manner that it is disposed in parallel with the metal frame 12 from the hook portions 14 at the other ends of the flexible anchors 13. This state is shown in FIG. 8.

FIG. 9 shows a state in which that part of the 3-D braid 11 of the assembly shown in FIG. 8 is laid on a base plate 16 of a mold which comprises the base plate 16, an outer side frame 17 in the form of a rectangle having an upper and lower opening set on the base plate 16, and further a rectangular inner frame 18 having upper and lower openings suspended in the mold. After the above setting has been completed, a previously mixed mortar mix or concrete mix is placed in the mold up to levels shown by broken lines 19 and 20 shown in FIG. 9. Thus, the manufacturing has been substantially completed, and a metal stud frame type curtain wall shown in FIG. 10 can be obtained by curing and demolding. Although according to this embodiment, adjustment portions 21 which are disposed in the periphery of the skin portion 10 of the concrete panel and which are bent inward at a right angle are shown, there adjustment portions 21 may, of course, be inclined like a dish or formed to have curvatures. The 3-D braid may be optionally disposed in the adjustment portions 21. However, during service of the product according to the present invention, the adjustment portions 21 are substantially free from outside pressure, and therefore they only need to secure their shape and are not necessarily provided with the 3-D braid.

Figure 11:
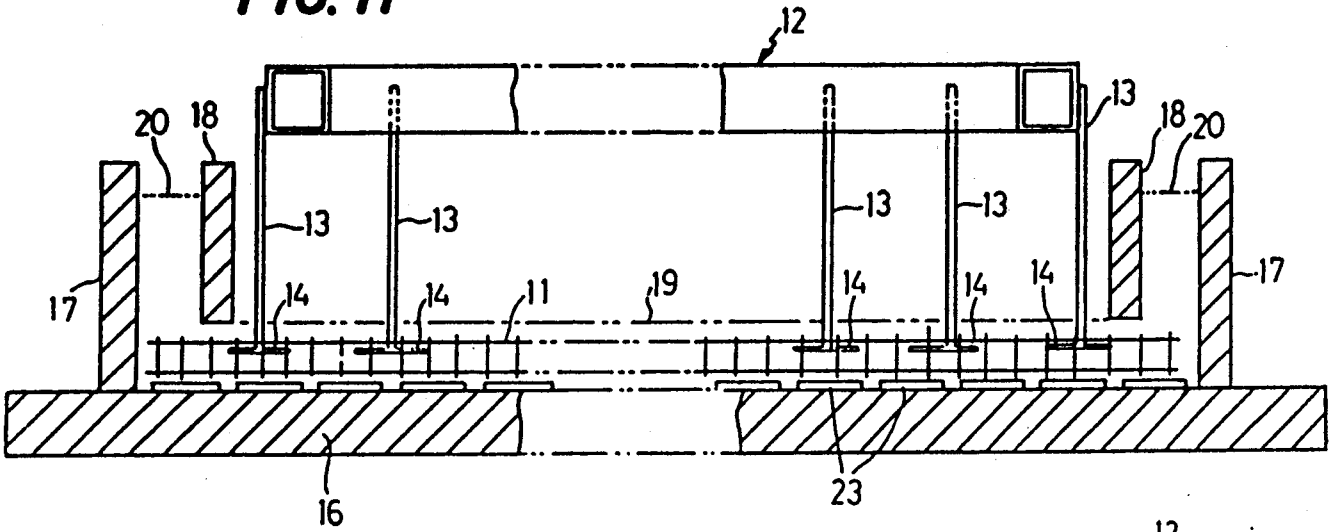
FIG. 11 is a schematic cross-sectional view of a manufacturing step similar to that shown in FIG. 9 in which tile finish is conducted.
Figure 12:
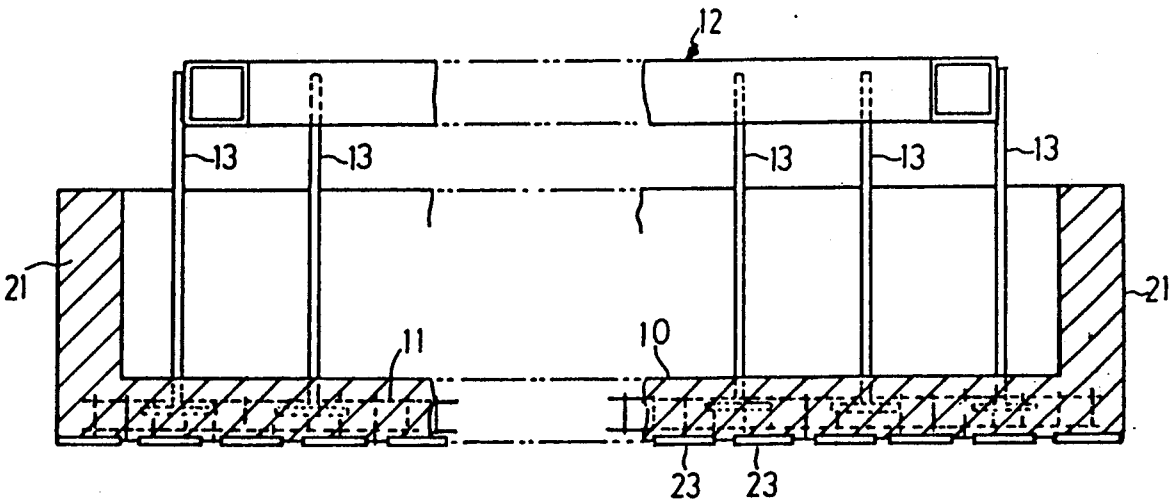
FIG. 12 is a schematic cross-sectional view of an example of a shape of a curtain wall obtained by means of the manufacturing step shown in FIG. 11.

FIGS. 11 and 12 illustrate a state similar to the example shown in FIGS. 9 and 10 in which the difference lies in a fact that tile finishing is conducted. That is, shown in FIG. 11, tiles 23 are laid on the surface of the base plate 16, and the 3-D braid of the assembly shown as in FIG. 8 is placed on them. As a result of this, a product in which tiles 23 are, as shown in FIG. 12, placed on the outer surface of the concrete panel 10 can be easily manufactured. As an alternative to the tiles 23, stone materials such as marble or other artificial materials may, of course, be used.

Figure 13:
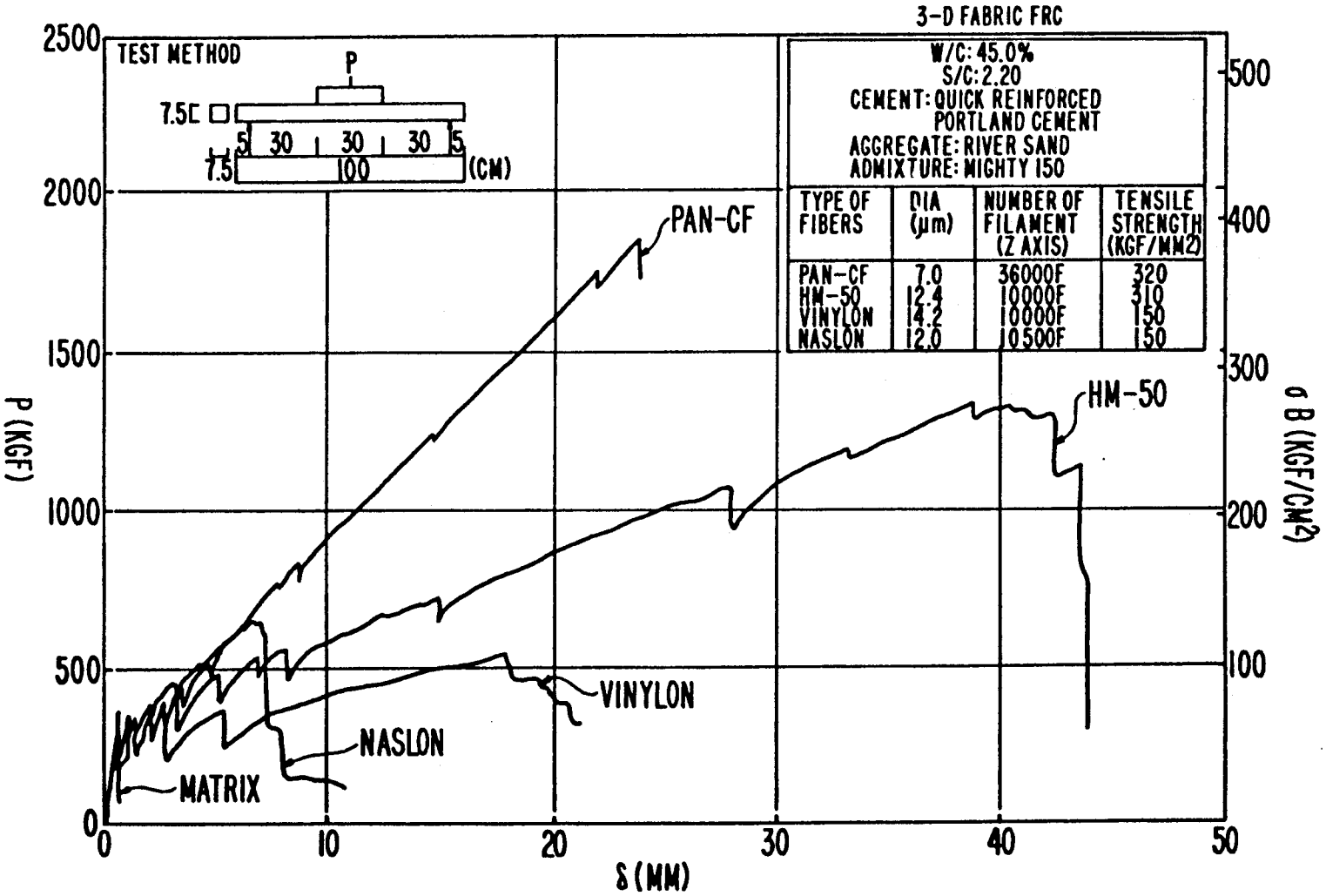
FIG. 13 is a curve showing load-deflection characteristics of a concrete panel according to the present invention.
Figure 14:
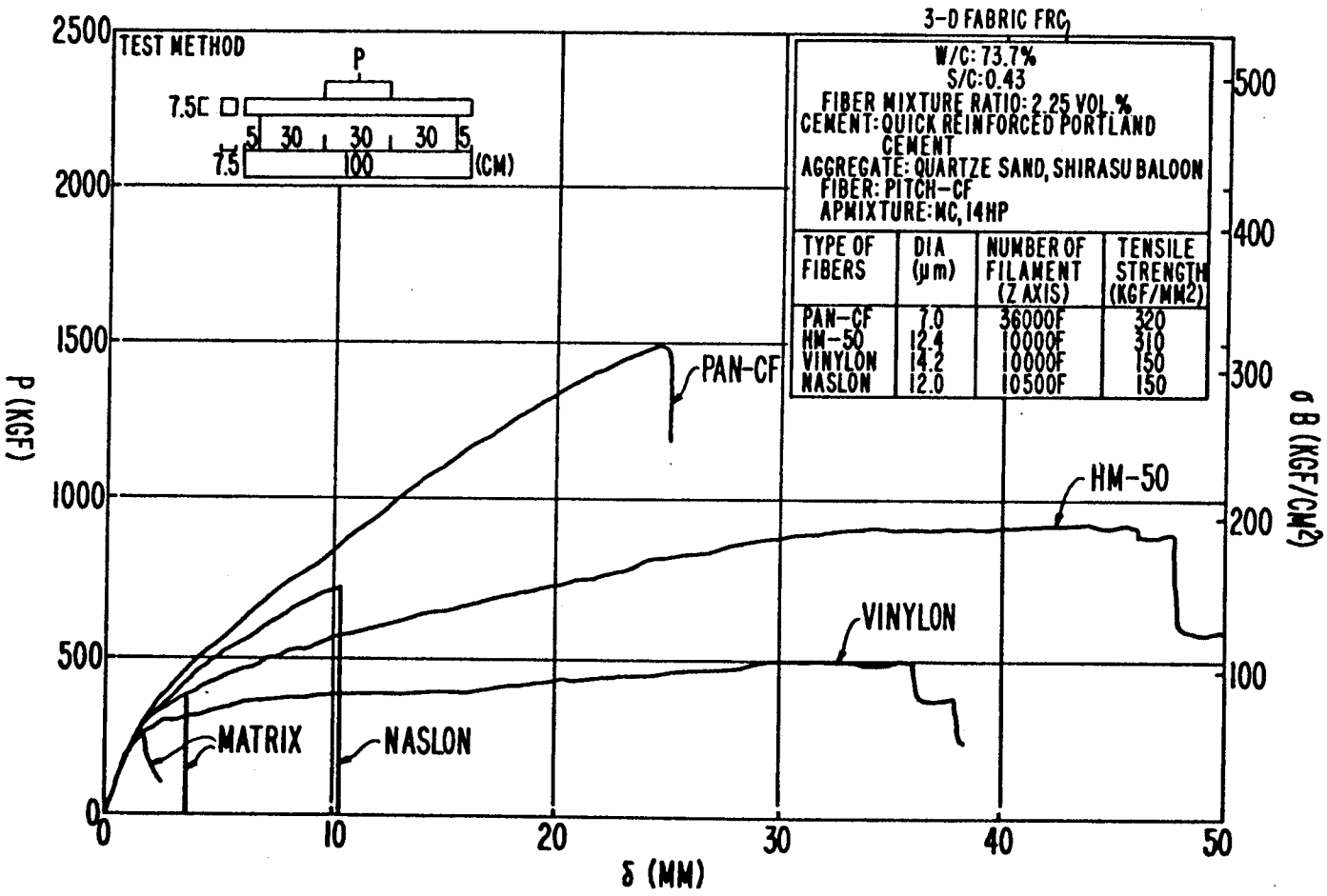
FIG. 14 is a curve showing load-deflection characteristics of another concrete panel according to the present invention.

FIGS. 13 and 14 show test results on the concrete panels with the 3-D braid according to the present invention. FIG. 13 shows a case in which a material whose matrix is mortar was used, the mortar using, as its aggregate, river sand. FIG. 14 shows a load-deflection curve of a material aged 28 days whose aggregate comprises quartz sand and shirasu baloon, and in which a CFRC is used as a matrix, the CFRC being formed in such a manner that pitch based carbon fibers of 6 mm in length are dispersed in the matrix. A single stage type of 3-D braid shown in FIG. 5 was used in both cases. The thickness of the concrete panel was 7.5 cm, the thickness of the 3-D braid was substantially 3 cm, and the pitch between cells of the 3-D braid was substantially 12.5 mm. As illustrated in detail in the figures, the fiber material forming this 3-D braid comprises 10,000 to 36,000 filaments each having a diameter of 7 to 14.2 μm. PAN-CF shown in a figures is a material which is constituted in such a manner that the fibers of the 3-D braid comprises pan type carbon fibers, and HM-50 is a material which is constituted in such a manner that the fibers of the 3-D braid comprises aramid fibers manufactured by Teijin Ltd. Venylon (Reg. TM) and Naslon each represents that the fibers of the 3-D braid comprises these fibers.

As shown in the results in FIGS. 13 and 14, in comparison with concrete which is formed only by a matrix in which 3-D braid is not provided, the panel in which 3-D braid is provided, particularly the panel whose 3-D braid is formed of carbon fibers or aramid fibers exhibited significant bending strength, to a level not obtained with the conventional concrete. Furthermore, as shown in FIG. 14, in a case wherein CFRC was used as the matrix, the stress-deflection curve did not show any amplitude generated through the curve, and a smooth curve as that obtained with rigid materials could be obtained. It represents a fact that large cracks did not occur during the bending process.

As described above, according to the present invention, a novel metal stud frame type curtain wall is provided as an alternative to the steel stud frame which uses the conventional GRC panel. All of the problems associated with the conventional panel are overcome. A completely novel material can be provided since the curtain wall according to the present invention particularly exhibits excellent strength and bending characteristics, and it can be used in exterior finish of multistory buildings. Furthermore, in a case wherein an artistic design quality is important, tile finish or stone finish can be freely conducted. Furthermore, since the flexible anchors are secured to the 3-D braid in the concrete layer, excellent reliability and durability in joining the metal frame and the panel can be obtained. Since the same exhibits excellent productivity, it can be manufactured at a low cost.

What is claimed is:

1. A curtain wall building panel, comprising:

a plurality of first sets of first fibers, each of said first fibers extending substantially parallel to a first direction, each of said first sets containing a plurality of said first fibers disposed in a respective plane and spaced from each other by respective first distances, each of said respective planes of said first sets being disposed substantially parallel to each other and being spaced from each other by respective second distances;

a plurality of second sets of second fibers, each of said second fibers extending substantially parallel to a second direction perpendicular to said first direction, each of said second sets containing a plurality of said second fibers disposed in a respective plane and spaced from each other by respective third distances, each of said respective planes of said second sets being disposed substantially parallel to each other and to said respective planes of said first sets and being spaced from each other by said respective second distances, said first fibers of each of said first sets being connected to said second fibers in an associated one of said second sets at intersection points;

a plurality of third fibers extending substantially parallel to a third direction substantially perpendicular to both said first and said second directions, each of said third fibers being connected to an associated one of said intersection points in each of said first and second sets, said first, said second and said third fibers being formed from one or more of the group consisting of carbon, aramid, glass, formalized polyvinylalcohol or polyethelene, whereby said first, second and third fibers comprise edges of at least one cell and define a self-supporting three dimensional braid;

a frame spaced from said braid and extending in a plane substantially parallel to said respective planes of said first and second sets;

at least one flexible anchor extending between said frame and said braid, a first end of said anchor being connected to said frame and a second end of said anchor being connected to said braid; and an essentially rigid building material encompassing, and at least essentially filling said at least on cell of, said braid and encompassing a portion of said at least one anchor.

2. A building panel as in claim 1, wherein said building material is a first building material and defines an exterior face opposite said frame, and further comprising a second building material connected to said exterior face.

3. A building panel as in claim 1, wherein said second end of said anchor includes at least one protrusion, and is connected to said braid by engagement between said protrusion and said braid.

4. A building panel as in claim 1, wherein said building material is concrete.

5. A building panel as in claim 4, wherein at least one of said first, said second and said third distances is greater than 5 mm.

6. A building panel as in claim 5, wherein said building material is a first building material and defines an exterior face opposite said frame, and further comprising a second building material connected to said exterior face.

7. A building panel as in claim 5, wherein said second end of said anchor includes at least one protrusion, and is connected to said braid by engagement between said protrusion and said braid.

8. A building panel as in claim 5, wherein each of said first, said second and said third distances is greater than 5 mm.

9. A building panel as in claim 8, wherein said building material is a first building material and defines an exterior face opposite said frame, and further comprising a second building material connected to said exterior face.

10. A building panel as in claim 8, wherein said second end of said anchor includes at least one protrusion, and is connected to said braid by engagement between said protrusion and said braid.

* * * * *